United States Patent [19]

Lund

[11] 4,058,208

[45] Nov. 15, 1977

[54] BOOK MATCHES WITH SAFETY LIGHTING FEATURES

[76] Inventor: Owen H. Lund, 90 Albion Place, Staten Island, N.Y. 10302

[21] Appl. No.: 676,811

[22] Filed: Apr. 14, 1976

[51] Int. Cl.[2] ..... A24F 27/00

[52] U.S. Cl. ..... 206/109; 44/42; 206/112

[58] Field of Search ..... 44/42–45; 206/106–115, 138

[56] References Cited

U.S. PATENT DOCUMENTS

| | | | |
|---|---|---|---|
| 1,586,919 | 6/1926 | Sakowski | 206/112 |
| 1,713,595 | 5/1929 | Doubleday | 44/42 |
| 2,089,355 | 8/1937 | Garside | 206/112 |
| 2,935,184 | 5/1960 | Olson | 206/109 |
| 3,939,970 | 2/1976 | Schoenberger | 206/108 |

*Primary Examiner*—William Price
*Assistant Examiner*—Douglas B. Farrow
*Attorney, Agent, or Firm*—Clarence A. O'Brien; Harvey B. Jacobson

[57] ABSTRACT

A matchbook of generally conventional design is provided, but the free edge of the front flap or cover thereof includes an integral backturned portion opposing the inner surface of the front panel or cover. The matches are provided with an ignitable coating devoid of portions thereof on one side of the matches and the striking surface on the cover for igniting the coating on the matches is applied to the inner surface of the flap opposing the inner surface of the front panel of the cover with the striking surface in a position normally hidden from view, the free edge of the flap and one end portion thereof being free of direct attachment to the opposing portions of the front cover and being displaceable away from the opposing inner surfaces of the front panel sufficient to receive the end of a match thereunder having the aforementioned ignitable coating thereon. The outer surface of the usual butt flap of the matchbook overlying the forward surfaces of the base ends of the matches is provided with a coating which simulates a match-striking surface but which is inoperative for that purpose and the outer surface of the rear flap or panel of the book matches at the end thereof adjacent the base ends of the matches and/or the exposed surface of the backturned portion is also provided with a similar inoperative simulated match-striking coating, which coatings may comprise printed coatings.

9 Claims, 7 Drawing Figures

BOOK MATCHES WITH SAFETY LIGHTING FEATURES

BACKGROUND OF THE INVENTION

Various book matches have been heretofore designed in a manner to discourage the lighting of matches by children. However, most attempts to provide a matchbook with safety lighting features have resulted in increases in the production costs over the cost of conventional present-day book matches.

Examples of various forms of book matches are disclosed in U.S. Pat. Nos. 483,165, 725,791, 1,232,300, 1,724,712, 1,745,036, 2,303,287, 3,871,517 and 3,891,083.

BRIEF DESCRIPTION OF THE INVENTION

The book match of the instant invention includes simulated match-striking surfaces on the front and rear portions of the cover between which the base ends of the associated matches are secured. However, these coatings or surfaces are inoperative as striking surfaces for the matches applied in the matchbook. Rather, the free end portion of the front flap or cover of the book match is provided with an integral backturned flap opposing the inner surface of the corresponding end of the front cover and one of the opposing surface portions of the backturned flap and front cover is provided with a match-striking surface or coating, color matched to the adjacent cover surfaces, which is operative and normally hidden from view. The backturned flap is secured down at one end thereof adjacent the corresponding side edge of the cover and the other end of the flap is displaceable outwardly away from the opposing inner surface of the cover to receive a match head between the flap and the cover for engagement with the striking surface. Further, only one side of the head of the matches provided includes an ignitable coating. Accordingly, a young child attempting to light a match from the book on the conventionally located but inoperative coatings will be unsuccessful. Further, even if a young child should become aware of the location of the operative striking surface of the book match cover there is only a 50 percent chance that the child will be successful in lighting a match inasmuch as only one side of the match is provided with an ignitable coating the opposite side of the match being provided with a coating of the same color but which is not ignitable. Also, the head of the match must be clamped or pinched between the backturned flap and the cover.

The main object of this invention is to provide a matchbook of substantially conventional design but including several safety features which substantially reduce the possibility of a young child being able to ignite one of the matches of the matchbook.

Another object of this invention is to provide an improved matchbook construction which need be provided with only one additional short flap portion and a staple-type fastener or the like in order to prevent the safety features of the instant invention.

Another object of this invention is to provide a matchbook including safety features which will coincide with suggested "Consumer Product Safety Commission — Bookmatches — Proposed Safety Standards" (Federal Register, Vol. 39, No. 172 — Wednesday, September 4, 1974) and also reduce the possibility of older users igniting all of the matches within the matchbook as well as "wild strike" ignitions.

A final object of this invention to be specifically enumerated herein is to provide an improved matchbook construction in accordance with the preceding objects and which will conform to conventional forms of manufacture, be of simple construction and easy to use so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
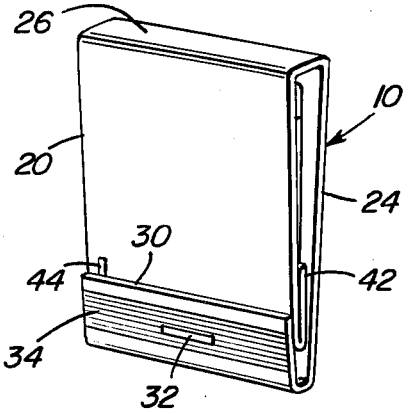
FIG. 1 is a front perspective view of a matchbook constructed in accordance with the present invention.
Figure 2:
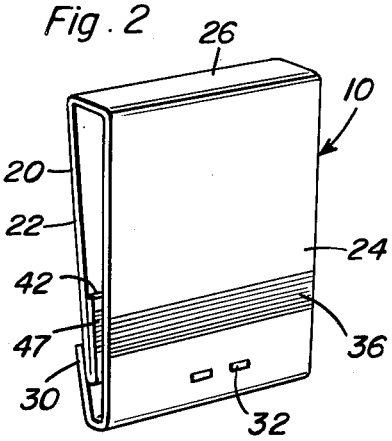
FIG. 2 is a rear perspective view of the matchbox.

Referring now more specifically to the drawings the numeral 10 generally designates the improved matchbook of the instant invention. The matchbook 10 includes a plurality of rows of side-by-side matches 12 including head ends 14 and base ends 16. The base ends 16 are connected to but may be torn from mounting panels 18 disposed in superposed relation.

The matchbook 10 further includes a cover 20 having opposite end portions 22 and 24 and a central transverse portion 26 formed integrally with and extending between the end portions 22 and 24. The cover 20 includes two longitudinally spaced transversely extending zones 28 which are crimped and define the extremities of the center portion 26 merging into the end portions 22 and 24 and along which the cover 20 may be bent or folded.

The end of the end portion 24 remote from the end portion 22 includes a reversely bent butt flap 30 overlying the forward surfaces of the rear panel of the cover 20 defined by the end portion 14 and the mounting panels 18 are secured between the butt flap 30 and the opposing portion of the end portion 24 by means of a staple 32 secured through the flap 30, the mounting panels 18 and the end portion 24.

The foregoing, as far as is complete, defines a conventional matchbook construction.

The front surface of the butt flap 30 is provided with a colored coating 34 simulating a striking surface but which is inoperative as a striking surface. In addition, the outer surface of the end of the end portion 24 remote from the end portion 20 includes a similar coating simulating a striking surface.

The front sides of the head ends 14 of the matches 12 have a colored coating 38 thereon simulating an ignitable coating, but the coating 38 is not ignitable as a result of frictional contact with a conventional striking surface. However, the rear sides of the head ends 14 of the matches 12 are provided with like colored ignitable coatings 40 which may be ignited upon frictional contact with a conventional striking surface. While the coatings 40 materially increase the thickness of the matches, the coatings 38 do not materially increase the thickness thereof.

The free end of the end portion 22 remote from the end portion 24 includes a backturned flap 42 which overlies the adjacent inner surfaces of the end portion 22 and one end of the flap 42 is anchored to the corresponding side edge portion of the end portion 22 by means of a staple 44. The free edge of the flap 42 and the end thereof remote from the staple 44 are displaceable outwardly from the opposing surfaces of the end portion 22 in order to receive the head end 14 of one of the matches 12 thereunder. Further, the inner surface of the flap 42 opposing the end portion 22 is provided with an operative matchstriking coating 46 while the outer surface of flap 42 is provided with an inoperative simulated striking coating 47.

Figure 3:
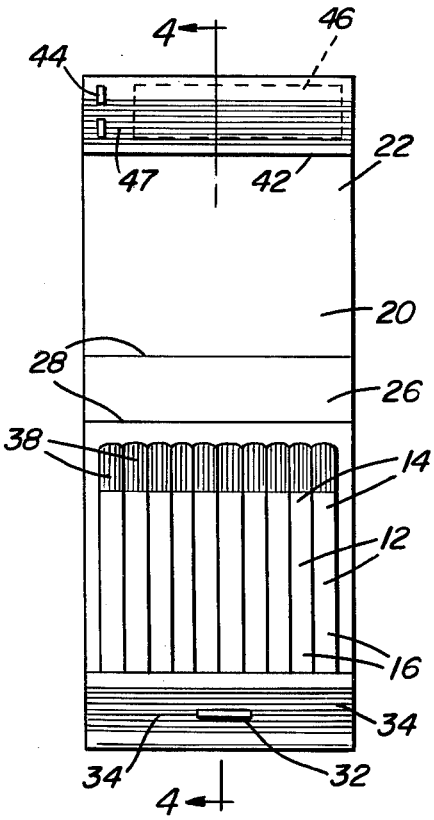
FIG. 3 is a plan view of the matchbook with the cover thereof in an open position.
Figure 4:
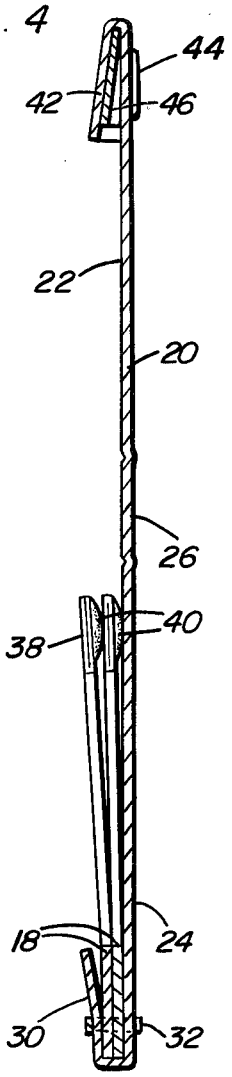
FIG. 4 is an enlarged sectional view taken substantially upon the plane indicated by the section line 4—4 of FIG. 3.
Figure 5:
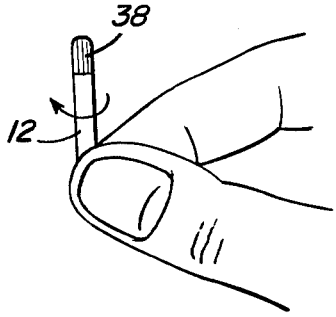
FIG. 5 illustrates the manner in which a match torn from the matchbook must first be rotated in position 180° in order to initiate the process of lighting the match.
Figure 6:
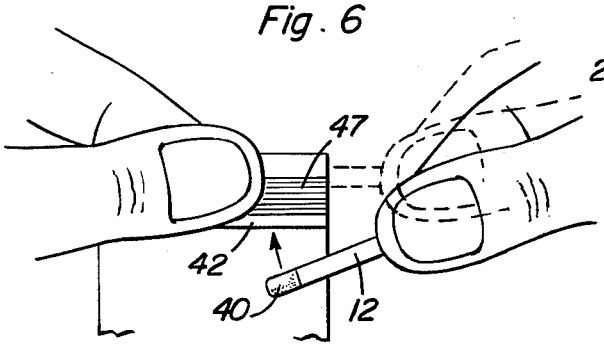
FIG. 6 is an elevational view illustrating the manner in which the rotated match may be inserted beneath the striking flap of the matchbook in order to complete the second step to be followed in igniting a match.
Figure 7:
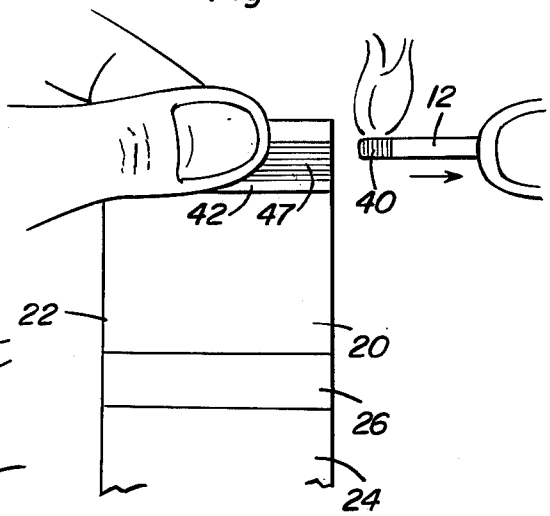
FIG. 7 is a fragmentary elevational view illustrating the third and final step to be followed in igniting a match.

Inasmuch as the staple 32 is secured through the butt flap 30 a spaced distance from the free edge of the flap 30 the free end of the end portion 22 and the backturned flap 42 may be inserted beneath the butt flap 30 in order to retain the cover 20 in a closed position in a conventional manner. However, when it is desired to ignite one of the matches 12, the cover 20 is opened to the approximate position thereof illustrated in FIG. 3 of the drawings and a right-handed person would hold the open cover 20 in his left hand and grasp one of the right-hand matches 12 between the forefinger and thumb of his right hand in order to tear the match from its corresponding mounting panel 18. Then, the base end of the match 12 is spun 180 degrees between the forefinger and thumb in the manner illustrated in FIG. 5 of the drawings in order that the coating 40 will be facing the person desiring to light the match. Then, the matchbook is held between the thumb and forefinger of the left hand in the manner illustrated in FIG. 6 and the head end of the match is slid upwardly beneath the flap 42 so that the coating 40 on the head end of the match 12 will oppose the coating 46. Then, finger pressure is applied between the forefinger and thumb of the left hand to frictionally clamp the head end of the match 12 beneath the flap 42 and the base end of the match 12 is pulled to the right as viewed in FIG. 7 of the drawings in order that frictional sliding contact between the coating 40 and the coating 46 will be effected to ignite the coating 40.

Of course, should a young child attempt to light one of the matches 12 he would rub either one side or the other of the head end of the match against either the coating 47 or the coating 34 or 36 without success. However, if a slightly older child, who may have more closely observed an adult lighting a match, should insert the head end of the match beneath the flap 42, it would be necessary for the child to first have the coating 40 opposing the coating 46 and to thereafter apply the necessary clamping action before the match would ignite. Thus, the matchbook 10 presents several safety features which greatly tend to reduce the possibility of a young child igniting one of the matches 12. Also, the location of the match head striking surface or coating 46 tends to reduce the possibility of users igniting all of the matches within the matchbook 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A matchbook including a plurality of matches including ignitable head end portions and base end portions, said base end portions connected to, but separable from, a mounting panel, a book cover including front and rear panels joined by means of an integral bendable reversely bent panel portion connecting and extending between adjacent parallel marginal portions of said front and rear panels, the end of said rear panel remote from said front panel including a reversely bent terminal end directed over the front face of said rear panel, said mounting panel being secured between said reversely bent terminal end and the opposing portion of said rear panel with said head ends extending toward said bendable panel portion, said front panel overlying the sides of said matches remote from said rear panel with the end of said front panel remote from said bendable panel portion removably anchored to the adjacent marginal edge of said terminal end, the outer surface of said reversely bent terminal end including a dark coating thereon simulating match head striking surface area thereon, the edge of said front panel remote from said bendable panel portion including a reversely bent terminal end flap closely overlying the inner surface of said front panel and secured to said front panel at one side marginal portion thereof, one of the opposing surface portions of said end flap and said front panel including a match head striking coating thereon in position normally hidden from view and the other of said opposing surface portions being devoid of a match head striking coating, the portion of said end flap remote from said one side marginal edge of said front panel being displaceable away from the opposing front panel portion sufficient to receive one of said head end portions therebetween for frictional engagement with said match head striking coating, said ignitable head end portions include opposite sides, each head end portion including an ignitable coating thereon limited to one of said opposite sides.

2. The combination of claim 1 wherein said one sides of said head end portions face toward said rear panel.

3. The combination of claim 1 wherein said one opposing surface portion comprises a portion of the side of said end flap opposing the inner surface of said cover panel.

4. The combination of claim 1 wherein the surface of said end flap remote from said cover panel includes a dark coating thereon simulating a match head striking area thereon.

5. A matchbook including a plurality of matches including base and ignitable head ends with said base ends removably united together into a connecting strip, an enclosing cover including an elongated panel member having first and second end portions defining front and rear panels, respectively, joined by an integral transversely extending and bendable central portion, the end of said back panel remote from said front panel including a reversely bent terminal end, said connecting strip being secured between said backturned terminal end and the opposing portion of said back panel with the head ends of said matches projecting toward said central portion, said front panel overlying the side of the matches remote from said back panel and including, on its free end remote from said central portion, a backturned flap overlying the inner surface of said front panel, said free end being removably anchored relative to said terminal end, said flap being attached to said front panel adjacent one longitudinal side edge of said panel member, the portion of said flap remote from said one longitudinal edge of said front panel being at least slightly displaceable away from the opposing front panel portion sufficient to receive the head end of one of said matches thereunder, one of the opposing surface portions of said flap and front panel including a match head striking coating thereon and the other of said opposing surface portions being devoid of a match head striking coating, said ignitable head ends including opposite sides, each of said head ends including an ignitable coating thereon limited to one of said opposite sides.

6. The combination of claim 7 wherein said one sides of said head end portions face toward said rear panel.

7. The combination of claim 9 wherein said one opposing surface portion comprises a portion of the side of said end flap opposing the inner surface of said cover panel.

8. A single ply matchbook cover including adjacent foldably interconnected integral back and front panels, a plurality of matches including ignitable head end portions and base end portions, said base end portions being connected to, but separable from, said cover, a first narrow reversely bent integral single ply butt flap carried by and extending along the edge portion of the back panel remote from the front panel and overlying the front surface of said edge portion, the front face of said butt panel having a simulated match striking surface thereon, the edge portion of said front panel remote from said back panel including a second narrow reversely bent integral single ply flap overlying the inner surface of the last mentioned edge portion, one of the opposing surface portions of said second flap and front panel having an operative match striking surface thereon and the other of said opposing surface portions being devoid of a match head striking coating, said ignitable head ends including opposite sides, each of said head ends including an ignitable coating thereon limited to one of said opposite sides.

9. The combination of claim 11 wherein said one opposing surface comprises the surface of said second flap.

* * * * *